US007954696B2

(12) United States Patent
Wingard

(10) Patent No.: US 7,954,696 B2
(45) Date of Patent: Jun. 7, 2011

(54) SURVIVABLE MAILBOX

(75) Inventor: Sam Wingard, Lagrange, IN (US)

(73) Assignee: Wingard's Sales LLC, Shipshewana, IN (US)

( * ) Notice: Subject to any disclaimer, the term of this patent is extended or adjusted under 35 U.S.C. 154(b) by 0 days.

(21) Appl. No.: 12/639,494

(22) Filed: Dec. 16, 2009

(65) Prior Publication Data

US 2010/0147939 A1 Jun. 17, 2010

Related U.S. Application Data

(60) Provisional application No. 61/122,856, filed on Dec. 16, 2008.

(51) Int. Cl.
*A47G 29/12* (2006.01)

(52) U.S. Cl. ..... 232/39; 248/417

(58) Field of Classification Search ..... 232/39; 248/131, 145, 415, 417
See application file for complete search history.

(56) References Cited

U.S. PATENT DOCUMENTS

| | | | | | |
|---|---|---|---|---|---|
| 1,299,810 | A * | 4/1919 | Toole et al. | ..... | 248/417 |
| 1,828,311 | A * | 10/1931 | Bink | ..... | 248/417 |
| 2,329,697 | A * | 9/1943 | Herman | ..... | 248/417 |
| 2,351,194 | A * | 6/1944 | Herman | ..... | 248/417 |
| 3,161,397 | A * | 12/1964 | Nolander | ..... | 248/417 |
| 3,385,550 | A * | 5/1968 | Doerner | ..... | 248/417 |
| 4,130,239 | A * | 12/1978 | Belsheim | ..... | 232/39 |
| 4,995,576 | A * | 2/1991 | Kieswetter | ..... | 248/145 |
| 5,215,283 | A * | 6/1993 | Gould | ..... | 248/145 |
| 5,445,086 | A * | 8/1995 | Bolduc | ..... | 232/39 |
| 2002/0139904 | A1 * | 10/2002 | Lowell | ..... | 248/145 |

* cited by examiner

*Primary Examiner* — William L. Miller
(74) *Attorney, Agent, or Firm* — Taylor IP

(57) ABSTRACT

A mailbox mount including a platform, a first angled element and a second angled element. A mailbox is attachable to the platform, which has a surface. The first angled element has an end connected substantially perpendicularly to the surface of the platform. The first angled element has an other end with an angled surface. The second angled element has an angled surface in contact with the angled surface of the first angled element. The first angled element being rotatable relative to the second angled element.

10 Claims, 2 Drawing Sheets

SURVIVABLE MAILBOX

CROSS REFERENCE TO RELATED APPLICATIONS

This is a non-provisional application based upon U.S. provisional patent application Ser. No. 61/122,856 entitled "Survivable Mailbox," filed Dec. 16, 2008, which is incorporated herein by reference.

BACKGROUND OF THE INVENTION

1. Field of the Invention

The present invention relates to mailboxes, and, more particularly, to a mailbox configured to survive an impact, such as the impact from snow being thrown from a snowplow.

2. Description of the Related Art

In 1863, US Postal carriers began delivering mail directly to home addresses. Originally, the mailmen would knock on the door and wait for someone to answer in order to deliver the mail. Homeowners began to install mailboxes to receive their mail when they were either not at home or unable to answer the door. In order to reduce the amount of time required for delivery, boxes were placed along curbs or other suitable locations closer to the public walkway. Initially, those in rural areas simply used empty bushel baskets, wooden boxes, or other containers in order to collect their mail. In 1923, the US Post Office required that households have a mailbox in order to receive the home delivery of mail.

In northern climates, people have used various methods to deflect snow that is thrown from snowplows, such as placing a barrier several feet in front of the mailbox, so that the barrier takes the brunt of the hit of the snow. Other methods depend on brute strength in an attempt to make an indestructible mailbox. Each of these approaches has problems. In the first instance, the barriers may take the brunt of the force the first time and be destroyed eliminating future protection of the mailbox. Further, the barrier may not be placed properly and it provides an additional hazard along the roadside for motor vehicles. Making the mailbox very strong endangers anyone who may run into it with their vehicle, causing significant damage to the vehicle.

What is needed in the art is a survivable mailbox that can deflect the force of snow hitting it.

SUMMARY OF THE INVENTION

The present invention provides an apparatus for deflecting an impact on a mailbox.

The invention comprises, in one form thereof, a mailbox mount including a platform, a first angled element and a second angled element. A mailbox is attachable to the platform, which has a surface. The first angled element has an end connected substantially perpendicularly to the surface of the platform. The first angled element has an other end with an angled surface. The second angled element has an angled surface in contact with the angled surface of the first angled element. The first angled element being rotatable relative to the second angled element.

An advantage of the present invention is that it dissipates the energy of an impact and reindexes the mailbox to a forward position.

Yet another advantage of the present invention is that the reindexing relies upon gravity to reposition the mailbox in a forward position.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention and such exemplification is not to be construed as limiting the scope of the invention in any manner.

DETAILED DESCRIPTION OF THE INVENTION

Figure 1:
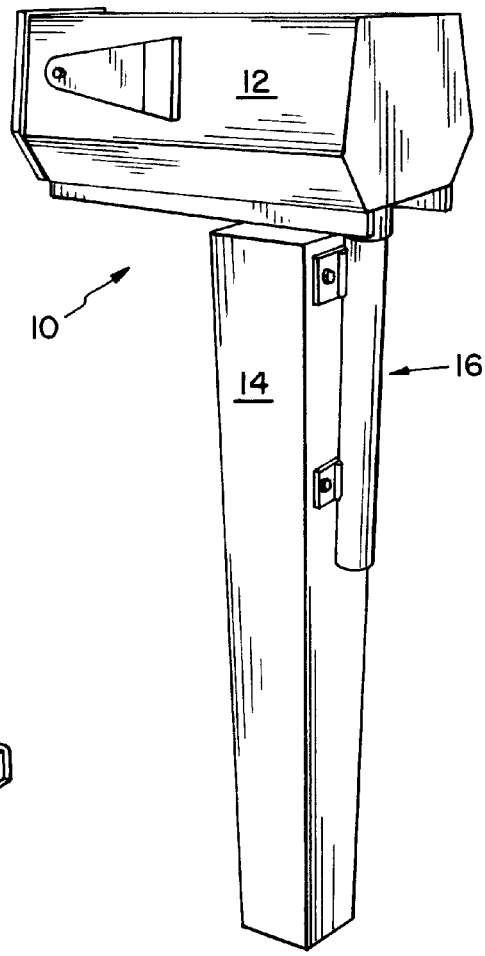
FIG. 1 is a perspective view of an embodiment of a survivable mailbox of the present invention.

Referring now to the drawings, and more particularly to FIG. 1, there is illustrated a mailbox assembly 10 including a mailbox 12, a post 14, and a mailbox mount 16 also known as a force diverter mechanism 16. Although mailbox 12 may be made of steel and may be integral with mailbox mount 16, any mailbox may be mounted to mailbox mount 16. Post 14 may be a cover 14 for a post that extends into the ground to which post cover 14 is connected. Alternatively, mailbox mount 16 can be connected to any post that is utilized for mailbox use.

Figure 2:
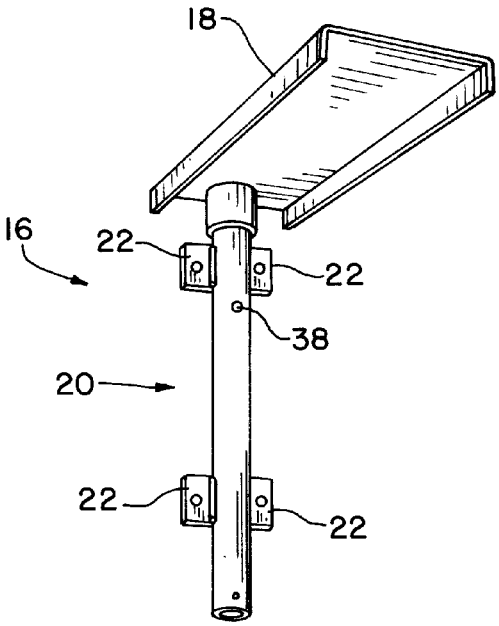
FIG. 2 is an assembled view of the mailbox mount utilized in the mailbox unit of FIG. 1.
Figure 3:
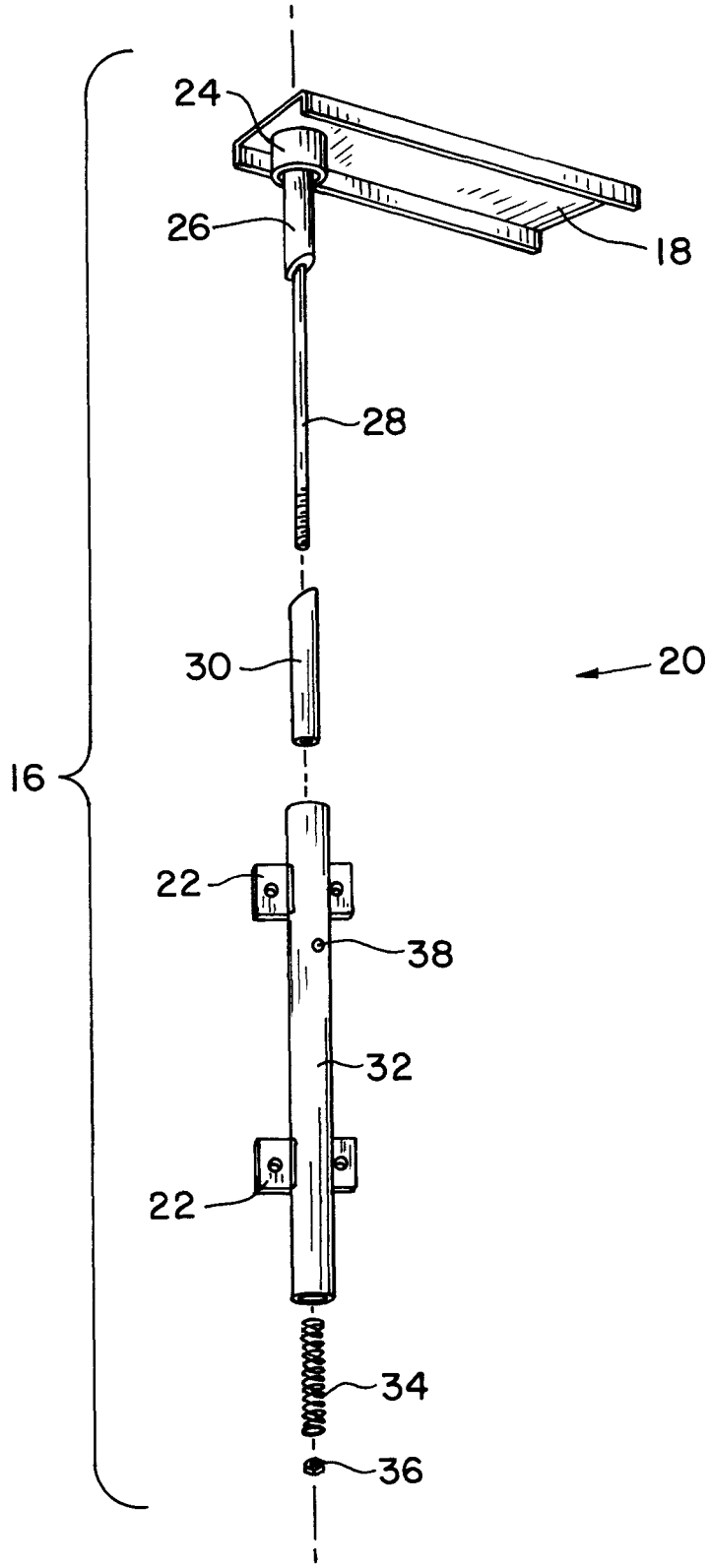
FIG. 3 is an exploded view of the mailbox mount of FIG. 2.

Now, additionally referring to FIGS. 2 and 3, there are illustrated further elements of mailbox mount 16 including mounting platform 18, swing assembly 20, and mounting flanges 22. Mailbox 12 can be mounted to platform 18 in the conventional manner. Swing assembly 20 allows mounting platform 18 to rotate in the event that box 12 is hit by an object, such as snow or ice that is thrown from a snowplow. Mounting flanges 22 are utilized to connect mailbox mount 16 to post 14. Mailbox mount 16 further includes an outer collar 24, an angled tube 26, a rod 28, an angled tube 30, a tube 32, a spring 34, a retainer 36, and an indexing fastener 38. Outer collar 24, angled tube 26, and rod 28 are all affixed in a substantially perpendicular manner to a surface of mounting platform 18. Rod 28 may be further attached to angled tube 26. Additionally, angled tube 26 and rod 28 may be made as an integral unit, with angled tube 26 having an angled surface to interact with tube 30. Although an angled surface is illustrated on angled tube 26 and angled tube 30, the surface may be other than flat and may be curved or have some other shape in order to more efficiently index platform 18. Outer collar 24 is sized to fit over tube 32 to thereby provide environmental protection for the elements contained within tube 32.

Tube 32 may be considered a housing 32 with an opening into which angled tube 30 is positioned in order to index mounting platform 18 in a desirable position with indexing fastener 38 being utilized to hold tube 30 in a fixed relationship with tube 32.

Rod 28 extends through angled tube 30 and is rotatable about an axis. Outer collar 24, angled tube 26, rod 28, angled tube 30, and tube 32 are all coaxially aligned with rod 28, angled tube 26, and collar 24 being rotatable relative to the fixed configuration of tube 32. An end of rod 28 is threaded for accepting threaded retainer 36. Spring 34 extends over a portion of rod 28 and is adjusted by the positioning of retainer 36, which thereby biases angled tube 26 against angled tube 30.

Tube 32 provides structural support to the entire assembly with outer collar 24 covering a portion of the top part of tube 32. A spring 34 is inserted over a portion of rod 28 and is positioned in the bottom of tube 32 and retainer 36 is positioned to provide a downward bias or pressure on the angled surface of angled tube 26 and angled tube 30 to enhance the indexing aspect of mounting platform 18 in a more defined manner. This allows mounting platform 18 to deflect force that is applied thereto by an impact against box 12.

When mailbox mount 16 is installed along a roadside, it advantageously absorbs the force of an impact and diverts it by allowing box 12 to rotate in the direction of the applied force. Once the force is dissipated, mailbox 12 is reindexed to the proper position due to the interaction of the sloped surfaces on angled tube 26 and angled tube 30 as influenced by gravitational force as well as the bias of spring 34. Platform 18 may rotate multiple revolutions if the applied impact force is high enough to cause such motion. It is this dissipation of the force rather than trying to resist it that allows the advantageous survivability of mailbox 12.

Indexing fastener 18 allows mounting flanges 22 to be attached to a side, a front, or a back of a post 14 by allowing the reorientating of angled tube 30 so that it is in a complementary position with angled tube 26 so that platform 18 is pointed in the desirable direction. Relocating the position of retainer 36 along rod 28 serves to vary the force of the bias against the bottom of rod 28 to thereby alter the characteristics of the swinging motion.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mailbox unit, comprising:

a mailbox;

a post configured to be coupled with the ground; and a mailbox mount coupled to said post, said mailbox mount including:

a platform to which said mailbox is attached, said platform having a surface;

a first angled element having an end connected substantially perpendicularly to said surface of said platform, said first angled element having an other end with an angled surface;

a second angled element having an angled surface in contact with said angled surface of said first angled element, said first angled element being rotatable relative to said second angled element;

a rod connected to at least one of said platform and said first angled element, said rod extending from said other end of said first angled element;

a housing having an opening, said second angled element being fixedly positioned within said housing, said rod extending through said opening, said second angled element being hollow, said rod extending through said second angled element; and a resilient element positioned in said housing and in contact with said rod, said resilient element providing a biasing force between said rod and said second angled element.

2. The mailbox unit of claim 1, wherein said rod, said first angled element and said second angled element are coaxially arranged relative to an axis, said rod and said first angled element being movable about said axis.

3. The mailbox unit of claim 2, wherein said platform is configured to move in a longitudinal direction when said first angled element is rotated about said axis.

4. The mailbox unit of claim 3, wherein said housing is a tube connected to said post.

5. The mailbox unit of claim 4, wherein said mailbox mount further includes a collar mounted to said platform, said collar being coaxially positioned relative to said axis, said collar being configured to slide over said tube.

6. A mailbox mount, comprising:

a platform to which a mailbox is attachable, said platform having a surface;

a first angled element having an end connected substantially perpendicularly to said surface of said platform, said first angled element having an other end with an angled surface;

a second angled element having an angled surface in contact with said angled surface of said first angled element, said first angled element being rotatable relative to said second angled element;

a rod connected to at least one of said platform and said first angled element, said rod extending from said other end of said first angled element;

a housing having an opening, said second angled element being fixedly positioned within said housing, said rod extending through said opening, said second angled element being hollow, said rod extending through said second angled element; and a spring positioned in said housing and in contact with said rod, said spring biasing said rod in a downward direction.

7. The mailbox mount of claim 6, wherein said rod, said first angled element and said second angled element are coaxially arranged relative to an axis, said rod and said first angled element being movable about said axis.

8. The mailbox mount of claim 7, wherein said platform is configured to move in a longitudinal direction when said first angled element is rotated about said axis.

9. The mailbox mount of claim 8, wherein said housing is a tube mountable to a post.

10. The mailbox mount of claim 9, further comprising a collar mounted to said platform, said collar being coaxially positioned relative to said axis, said collar being configured to slide over said tube.

* * * * *